United States Patent [19]

Frederick

[11] 4,421,643

[45] Dec. 20, 1983

[54] SWIMMING POOL FILTERING SYSTEM

[75] Inventor: Stanley H. Frederick, Ramsey, N.J.

[73] Assignee: International Telephone and Telegraph Corporation, New York, N.Y.

[21] Appl. No.: 946,979

[22] Filed: Sep. 29, 1978

Related U.S. Application Data

[63] Continuation of Ser. No. 742,387, Nov. 16, 1976, abandoned, which is a continuation of Ser. No. 627,179, Oct. 30, 1975, abandoned.

[51] Int. Cl.[3] ..... E04H 3/20

[52] U.S. Cl. ..... 210/138; 4/507; 210/169; 210/416.2; 417/12

[58] Field of Search ..... 210/169, 416.2, 65, 210/138; 318/224, 225, 340; 417/410, 12, 372; 310/66; 4/172.17

[56] References Cited

U.S. PATENT DOCUMENTS

| | | | |
|---|---|---|---|
| 2,073,404 | 3/1937 | Hobbs | 417/331 |
| 2,669,683 | 2/1954 | Burolett | 318/224 A |
| 2,689,933 | 9/1954 | Veinott | 318/224 A |
| 2,813,239 | 11/1957 | Cour | 318/224 A |
| 3,263,144 | 7/1966 | Neyhouse et al. | 318/224 A |
| 3,504,795 | 4/1970 | Johnson | 210/83 |
| 3,528,548 | 9/1970 | Sheckler | 210/169 |
| 3,588,649 | 6/1971 | Heine et al. | 318/224 A |
| 3,801,992 | 4/1974 | Sable | 4/172.17 |

*Primary Examiner*—Peter A. Hruskoci

*Attorney, Agent, or Firm*—John T. O'Halloran; Robert P. Seitter

[57] ABSTRACT

A swimming pool filtering system of the closed recirculatory type having a series connected strainer, pump and filter is provided with a close coupled pump drive motor having two sets of stator windings for allowing the selection of one of two water circulation rates to achieve more efficient pool water maintenance. A specific circulation rate may be manually selected or periods of selected circulation rates may be automatically programmed using a motor stator that is energized through a timer. Reduced pump speed during periods of little or no use results in substantial energy savings and a reduction of noise pollution during evening hours.

6 Claims, 7 Drawing Figures

ENERGI SAVER MARDUR POOL PUMP

TYPICAL MONTHLY ELECTRICAL SAVINGS

12 HRS. RUNNING @ HIGH SPEED & 12 HRS. RUNNING @ LOW SPEED

| PUMP MODEL | H.P. | VOLTS | OPERATING POINT | Cost Per Kilowatt Hr. $.04 | $.05 | $.06 |
|---|---|---|---|---|---|---|
| 1½HP21ECT-A3 | 3/4 | 115 | 45GPM @ 45' | 9.79 | 12.24 | 14.69 |
| 1½HP22ECT-A3 | 1 | 230 | 50GPM @ 48' | 13.30 | 16.63 | 19.95 |
| 1½AP28ECT-A3 | 1 | 230 | 50GPM @ 50' | 15.20 | 19.00 | 22.80 |
| 1½AP29ECT-A3 | 1½ | 230 | 60GPM @ 64' | 19.51 | 24.39 | 29.27 |

8 HRS. RUNNING @ HIGH SPEED & 16 HRS. RUNNING @ LOW SPEED

| PUMP MODEL | H.P. | VOLTS | OPERATING POINT | Cost Per Kilowatt Hr. $.04 | $.05 | $.06 |
|---|---|---|---|---|---|---|
| 1½HP21ECT-A3 | 3/4 | 115 | 45GPM @ 45' | 13.05 | 16.31 | 19.58 |
| 1½HP22ECT-A3 | 1 | 230 | 50GPM @ 48' | 17.86 | 22.33 | 26.79 |
| 1½AP28ECT-A3 | 1 | 230 | 50GPM @ 50' | 20.26 | 25.33 | 30.39 |
| 1½AP29ECT-A3 | 1½ | 230 | 60GPM @ 64' | 26.01 | 32.51 | 39.02 |

NOTE: All data based on randomly selected pumps, tested with two-speed motors and subject to manufacturing variations.

FIG. 7

SWIMMING POOL FILTERING SYSTEM

This is a continuation of application Ser. No. 742,387, filed Nov. 16, 1976, now abandoned, which was a continuation of application Ser. No. 627,179, filed Oct. 30, 1975, now abandoned.

BACKGROUND OF THE INVENTION

1. Field of the Invention

The present invention relates to swimming pool filtering systems and more particularly to a system having selectable water circulation rates.

2. Description of the Prior Art

Residental swimming pools have become popular and common place in today's society; however, pool owners are experiencing a substantial increase in pool maintenance costs due to the increased cost of both energy and pool chemicals. It has also been discovered that pools tend to be a nuisance especially during evening hours when the filtering system generates a noise level that is quite obnoxious in a quiet residential area. The low level hum of a filtering system enters open bedroom windows and often keeps restless sleepers awake.

Pool owners have taken several approaches in an attempt to overcome these problems. The most common procedure is to turn off the filtering system during certain periods of the day and in particular during the night time hours. While this procedure eliminates the night time noise and reduces the overall energy consumption, it provides only a false economy and cannot be considered a satisfactory solution since it subjects the pool owner to certain risks. Turning off the filtering system could result in a substantial health hazard since it allows the development of dangerous levels of pollutants.

When the circulating pump is turned off for extended periods of time, there is a substantial risk that algae formations may rapidly overrun the pool. The elimination of this algae requires heavy doses of algae killing chemicals, the cost of which greatly exceeds the savings in energy and the pool cannot be used for a period of time. Normally, an oxidizing agent, such as chlorine, kills the algae and maintains it under control in the pool. However, the algae consumes a certain amount of the oxidizing agent and once the oxidizing agent is consumed in a particular portion of the pool, uncontrolled algae growth is initiated which rapidly spreads throughout the pool. Thus, it is essential that the pool water be continuously circulated to replenish the oxidizing agent that is consumed in remote corners of the pool. It is clear that the pool owner, by turning off the circulating pump, assumes the risk of rapid algae growth and the accumulation of other contaminants in the pool which may require the use of chemicals for repurifying the water, the cost of which would greatly exceed any energy savings.

Certain pool owners have attempted to avoid the algae formation problem by cycling the filter system on and off at 30 minute intervals; however, this starting and stopping of the pump motor is extremely detrimental to the motor and will severely reduce the life of the motor.

For the pool owner that uses a diatomaceous earth filter, turning off the circulating pump causes the filter to lose its cake and necessitates the replacement of the diatomaceous earth at a considerable inconvenience.

Heretofore, an efficient energy saving filter system has not been available to the individual pool owner.

Swimmming pool filter systems have been designed using circulating pumps that had sufficient capacity to provide the necessary head to prime the system and sufficient flow to vacuum the pool and clean the pool after a storm. Thus, an efficient system was considered to be one that utilized a pump with just enough capacity to meet these demands and extra capacity resulted in an inefficient system.

One unique problem that faced the designer of a swimming pool filter system was the variable resistance presented by the filter. A clean filter would present a known resistance; however, the resistance increased asymptotically as the filter became dirty. Thus, the designer had to contend with a variable system head curve.

Referring to FIG. 6, there is shown a series of system head curves resulting from increased filter resistance. The graph of FIG. 6 shows curves for the system having Total Head (H) plotted against resulting capacity or Flow Rate (Q). The solid line labeled Total Circulation System Head represents the total system curve taking into account the entire circulation system resistance including a clean filter, strainer, heater, piping, valves and elbows. The static suction lift is not reflected in the curve. The dashed lines show the effect of increased filter resistance on the system head curve.

FIG. 6 also shows the typical operating characteristics of a centrifugal pump and the curve is labeled H.Q. System performance may be evaluated by comparing the H.Q. curve and the system head curves. With a clean filter, a head of about 21 feet would result in a flow of about 88 gallons per minute; however, with a dirty filter, a head of 54 feet develops a flow rate of about 25 gallons per minute. Thus, the filter itself can result in increased pressure drops of over 33 feet.

As a result of this increased pressure drop across the filter, prior art designers have considered it essential that the pump operating characteristics provide sufficient head to overcome this pressure drop.

In an attempt to increase pump efficiency and thereby reduce the energy consumption, attempts were made to redesign the pump. A smaller diameter impeller reduced the energy consumption but simultaneously reduced the pumping capacity to an extent that the head was not sufficient to prime the system and the circulation rate was not sufficient for vacuuming the pool and the pool could not be quickly cleaned after a storm or during heavy use. In addition, the lower circulating rate could not meet certain governmental codes which require that a filtering system be capable of circulating the entire pool capacity during periods of time varying from eight to twelve hours depending upon the particular code involved.

Another energy saving expedient was to provide a slower operating motor; however, this resulted in the same problems experienced with the smaller diameter pump impeller, namely insufficient head for priming and insufficient flow rate for vacuuming, and was not a satisfactory solution. In addition, this expedient was summarily dropped because the pump could not provide sufficient head to overcome the filter pressure drop previously described. Thus, the swimming pool industry lived with the problem and used inefficient pumps that had sufficient capacity for maximum demand.

SUMMARY OF THE INVENTION

In attempting to provide an energy saving swimming pool filter, the Applicant recognized that the swimming pool filter industry designers had overlooked or did not understand the importance of system head curves. The industry was so preoccupied by the pressure drop $\Delta H$ shown in FIG. 6 and the need for sufficient capacity to overcome this drop that they failed to realize that under most normal conditions a much lower capacity pump could be satisfactorily used with substantial energy savings. It was a common misconception that flow rate is controlled solely by pressure and therefore low capacity pumps could not be used since a slight rise in the filter pressure drop would quickly exceed the shut-off head of the pump, resulting in zero flow.

The Applicant discovered that a lower capacity pump could operate satisfactorily during normal conditions other than vacuuming, system priming or cleaning up after a storm. Lower flow rates provided excellent filtering and did not require more frequent filter backwashing. However, the increased capacity was required for the previously mentioned periods of use.

The increased capacity could be provided by the use of an auxiliary pump but this was too expensive for home installations.

Another method of providing the increased capacity would be through the use of a two-speed pump wherein the lower speed would be used for normal operation, and the high speed for vacuuming and establishing a prime. The two-speed pump would provide a lower speed characteristic as indicated by curve $H.Q.L_o$ in FIG. 6. As can be seen from FIG. 6, the flow rates will be approximately one-half of that for the high speed but the shut-off head will not be reached any faster than at the high speed since the increased pressure drop across the filter $\Delta H_{Lo}$ is substantially less than the drop $\Delta H_{Hi}$ at high speed operation.

Dual speed operation could be achieved by the use of a single speed motor long coupled to a pump through a speed changing gear train or belt drive arrangement. Such a structure is too complex and expensive for home swimming pool and that solution was rejected.

Thus, the present invention contemplates the use of a two-speed pump motor that provides a high capacity for system priming and high circulation rates for vacuuming operations, periods of heavy pool use or for clean-up after a storm while providing a lower circulation rate during other periods of time. The low circulation rate is sufficient to prevent the pool from becoming stagnant with the resulting growth of algae while providing a considerable savings in energy costs. The lower circulation rate also results in an unexpected benefit, that being a substantial reduction in noise levels.

Two speed and variable speed motors are rather common and the method of achieving the variable speed is usually dependent upon the use to which the motor is applied. Variable speed may be obtained through the use of a variac while dual speed may be achieved through the use of a rectifier device. Both of these means of providing speed changes consume energy and are thus inefficient methods of providing speed control and could not be considered for use in an efficient filtering system.

The present invention contemplates the use of a motor wherein the two-speed capability is achieved by the efficient use of two separate stator windings for two-pole or four-pole operation to achieve nominal motor speeds of 3500 RPM and 1750 RPM. The motor is provided with a manual selector switch by which the motor may be operated at high or low speed. Optionally, a timer may be provided to automatically control the motor to operate at a selected speed during selected periods of time. A timer controlled motor may be manually switched to a different speed by merely turning the timer dial to a period requiring the desired speed. Such a manual selection may be used for turning the motor to high speed for cleaning up after a storm or for vacuuming the pool. It is also contemplated that the system could be provided with a sensor such as an optical device for sensing the clarity of the water and for energizing the high speed winding when the water clarity is reduced to a predetermined level.

The present invention satisfies governmental code requirements by having the capability of circulating all of the pool water within the designated time periods and in addition provides for low speed operation to substantially reduce the energy consumed. An unexpected beneficial result was also realized by elimination of the noise pollution caused by the circulating pump during quiet evening hours. These beneficial results are uniquely achieved without subjecting the pool owner to the risk of water contamination that may result when the filter system is turned off and which may require the use of substantial amounts of chemicals for repurifying the water.

Normally, efficiency ratings only take into account energy consumption; however, when considering total pool maintenance efficiency, one must weigh the desired result, that being a degree of water clarity and purity, against the total monetary cost of energy and chemicals and a number of intangible items such as noise pollution, pool down time and time required for maintenance. All of these factors must be taken into consideration in the proper design of a pool filtering system. The present invention, through its unique use of a two-speed motor in a pool filtering system, can achieve the desired degree of water clarity at a considerably reduced total cost.

The primary objective of the present invention is to provide a system that more efficiently maintains pool water purity and clarity.

Another objective of the present invention is to provide a circulating pump for a pool filtering system that consumes less energy than those heretofore available.

Another objective of the present invention is to provide a circulating pump for a pool filtering system that creates less noise pollution than those heretofore available.

Another objective of the present invention is to achieve the above objectives without creating a health hazard.

These and other objectives and advantages of the invention will become more apparent from the following description taken in conjunction with the accompanying drawings wherein three embodiments of the invention are described.

BRIEF DESCRIPTION OF THE DRAWINGS

FIG. 7 shows the monthly energy savings that may be realized by various size pumps under various operating conditions.

DESCRIPTION OF THE PREFERRED EMBODIMENT

Figure 1:
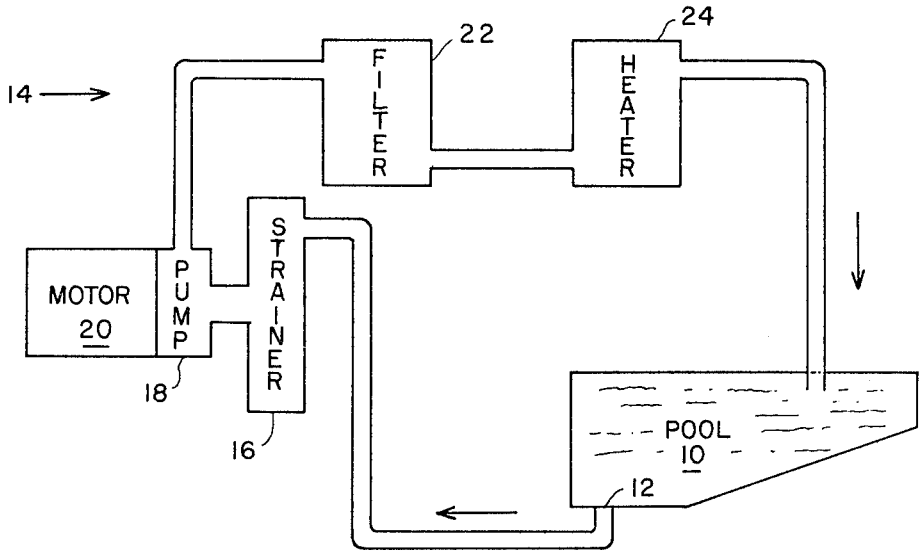
FIG. 1 is a schematic diagram showing a complete pool filtering system.

Referring to FIG. 1, there is shown a pool 10 having an outlet 12 for connection to a filter system 14. Outlet 12 is connected to an inlet of a strainer 16 which has an outlet connected to a centrifugal pump 18 which is coupled to a motor 20. Preferably, pump 18 and motor 20 are closely coupled as an integral unit on a single shaft. The strainer, pump and motor are normally provided as integral units by swimming pool pump manufacturers. The strainer and pump may be similar to that used on Mar Dur Model 1½ HP21EC-A3 sold by ITT Marlow, the assignee of the present invention. The pump outlet is connected to the inlet of a filter 22 which provides filtered water to an optional heater 24 for heating the circulated water which is thereafter deposited back into the pool 10 at a point below the water level so that the circulatory system is closed. There are many forms of commercially available filters and heaters that may be used in the system and the selection of any particular type is not important to the present invention.

Figure 2:
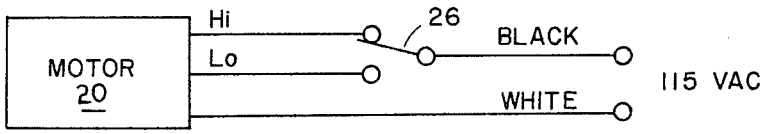
FIGS. 2, 3 and 4 are schematic diagrams of a portion of the present invention.

The motor 20 of the present invention is a two-speed motor having nominal speeds of 1750 RPM and 3500 RPM. The two-speed feature of the motor is preferably achieved through the use of a dual stator winding wound to selectively provide two-pole and four-pole operation. By using the dual stator windings, a more favorable energy efficiency is provided by the motor as compared with other speed varying means such as rectifiers or variacs. The motor for residential use will usually be in the size range of ⅓ to 2 horsepower which is generally considered sufficient to handle the requirements of residential pools. Of course the invention could be used with larger size motors and pools. The motor may be designed for either 115 or 230 volt AC operation. In the least complex embodiment as shown in FIG. 2, the motor will be equipped with a manually operated switch 26 which may be a single pole double throw toggle switch. When the switch is moved to one side the high speed winding is energized while in the other position the low speed winding is energized.

Figure 3:
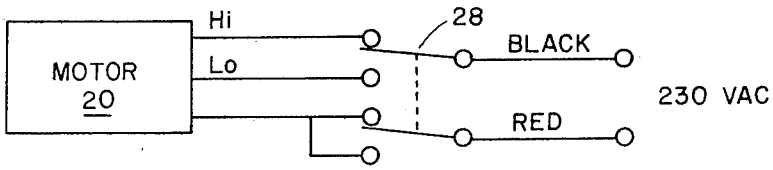

Referring to FIG. 3, there is shown the preferred circuit arrangement for a 230 volt AC motor which requires that both power lines be controlled by the switch. Thus, a double pole, double throw switch 28 may be used to control both power lines of the 230 volt energy source.

Figure 4:
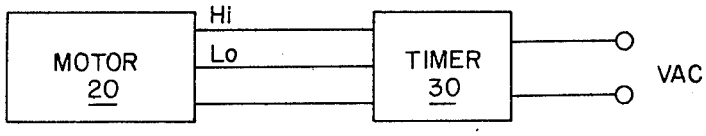

In FIG. 4, there is shown a more sophisticated embodiment of the invention wherein a timer 30 is provided for automatically controlling the speed of the motor during periods selected by the home owner. The timer may be similar to GE control CR121BA02 which may be used with a ½ horsepower motor. Depending upon motor size, relay control switches may be required for use with the timer to overcome the detrimental effects of high current on the switching contacts; however, this is a matter of design choice and does not form a part of this invention. In the event it is desirable to operate the motor at a speed other than the speed called for by the timer, the timer dial may be rotated till the speed changes. After the alternate speed is no longer desired, the timer is merely reset by turning the dial to the actual time. Of course, separate override and power off switches could be provided if desired. The timer is energized from a standard AC source and provides two outputs for energizing either the high or low speed winding.

In an alternate and more sophisticated embodiment timer 30 may be replaced with a sensor for sensing water clarity and for energizing the high speed winding when the clarity is reduced to a certain predetermind level.

The sensor could be an optical device that senses the amount of light transmitted through a specified amount of the pool water. The sensor could be mounted in a translucent portion of the filter piping system or in the actual pool itself.

Figure 5:
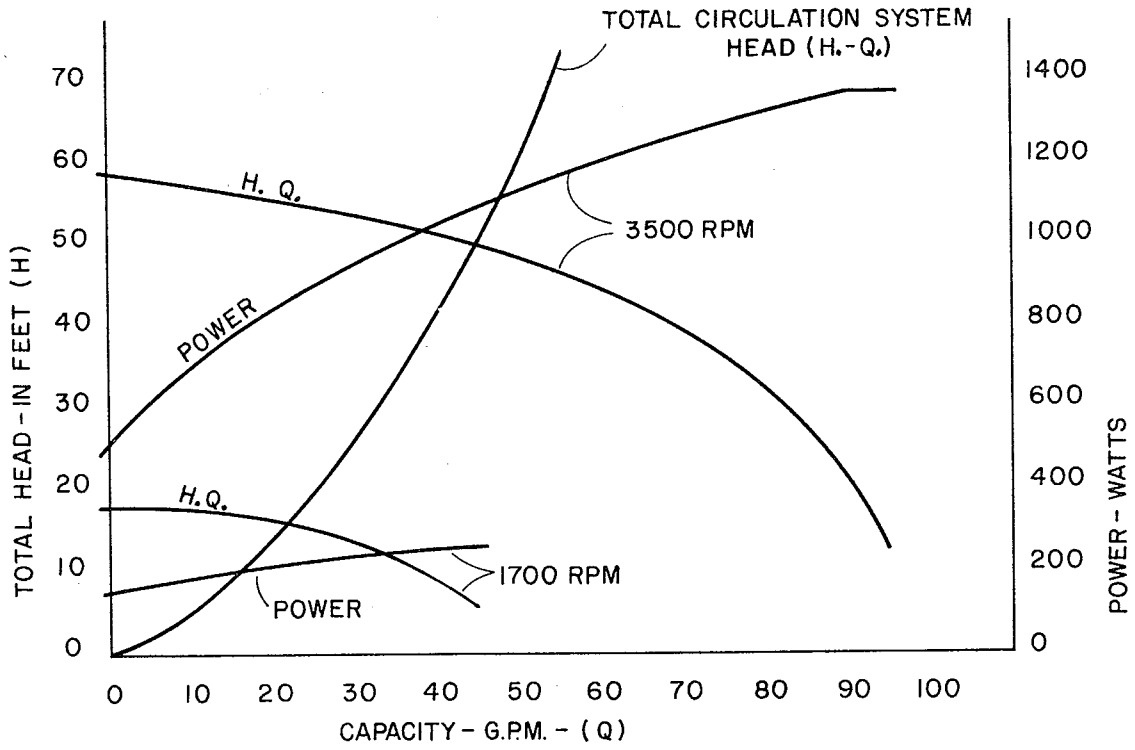
FIG. 5 is a graph showing the operational characteristics of a typical system using the present invention.
Figure 6:
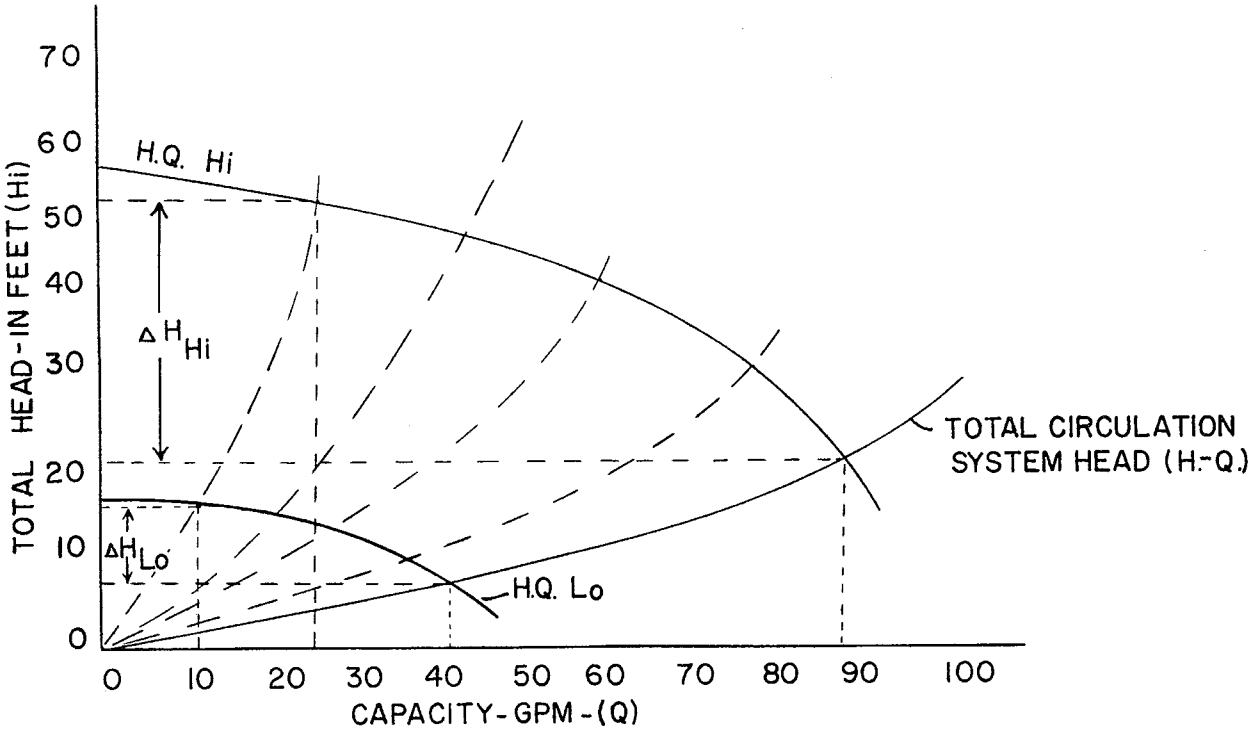
FIG. 6 is a graph showing the operational characteristics of pumps operating at different speeds with varying system head curves.

Referring to FIG. 5, there is shown a graph of the operating characteristics of a typical motor pump combination constructed in accordance with the present invention. The particular pump motor used was a monimal NSF rated one horsepower motor. The graph shows the flow curves (H.Q.) for 3500 RPM and for 1750 RPM operation by plotting flow rate in gallons per minute against the total head in feet. The power curves for the same speeds show energy consumed at each operating speed in watts against flow rate in gallons per minute. Superimposed on the curves is a total circulation system head curve representing possible operating points for a particular pool installation at a particular condition of the filter. The curve is similar to one of the system head curves shown in FIG. 6. From a review of FIG. 5, it will be noted that the nominal motor speed of 3500 RPM produces a flow rate of 45 gallons per minute in the particular system with an energy consumption of 1080 watts. At the 1750 RPM speed, a flow rate of 21 gallons per minute was achieved with an energy consumption of 200 watts. It is apparent from this system curve that by dividing the flow rate approximately in half, the energy consumption is reduced to one-fifth. Comparable results can be achieved with similar systems and other motor sizes.

The one horsepower rated motor used to obtain the data shown in FIG. 5 has sufficient pumping capacity for use with a 32,000 gallon pool so that the entire pool capacity may be filtered during a twelve-hour period to conform with governmental codes. If the high speed operation is continued for twenty-four hours a day using existing prior art motors, 777.6 kilowatt hours of electricity would be consumed during a thirty-day month at a cost of $38.88 if the price for electricity is 0.05 dollars per kilowatt hour. If the motor is operated at high speed only during the high usage time which may be approximately eight hours a day, the energy consumption is reduced to 355.2 kilowatt hours for a monthly cost of $17.76 and a monthly savings of $21.12. Considering that the cost of energy is increasing, this savings will in all likelihood increase.

FIG. 7 shows the monthly savings that may be realized using the present invention with various capacity pumps at different operating conditions.

Another important unexpected advantage realized by the present invention is the substantial reduction in noise that is achieved by operating at the lower speed. The noise level in a quiet residential area increased by 14.5 db at the standard testing distance of 1 meter from the motor when the high speed winding was energized. At the low speed, there was only a 0.5 db increase in noise level at the 1 meter distance and no discernable increase at 5 feet.

Further tests indicated that the low speed operation resulted in a 68% reduction in noise level. These tests were run under ideal conditions with no noise reflective surfaces, so that the motor noise was dissipated about a full 360 degrees without the production of any echo.

In actual installations, the motor may be installed adjacent a building, wall or fence where reflected sound greatly increases the problem of noise pollution. Noise level increases are measured in db, or sound pressure, and may not appear to be substantial on paper; however, they can become extremely obnoxious in the still of the night. Thus, the present invention provides a substantial reduction in noise pollution when operating at the lower speed.

From the foregoing, it is apparent that the present invention provides a truly more efficient pool water maintenance system which requires less energy and chemicals to achieve a desired degree of water clarity. While providing this improved efficiency, the system of the present invention also eliminates the risk of rapid algae growth, high contamination levels, reduced-motor life caused by motor cycling and the detrimental effects of turning off the pump on a diatamaceous filter all of which were experienced with prior art methods of reducing energy consumption. In addition to the above-mentioned beneficial results, the present invention also provides the unexpected result of significantly reduced levels of noise pollution and fewer complaints from the neighbors.

What is claimed is:

1. A swimming pool filter system, comprising:

a closed water circulating system having an inlet for receiving water from said pool and an outlet for discharging water into said pool at a point below the normal water level;

a filter connected in said closed water circulating system for filtering pool water, said filter and closed water circulating system defining a variable system head curve dependent upon the particular condition of said filter when said water circulating system is primed with water;

a centrifugal liquid pump connected in said closed water circulating system;

a motor closely coupled to said pump, said motor being capable of operating at at least two speeds for driving said pump to produce at least two different pool water circulation rates through said water circulating system in accordance with the instantaneous system head curve for a water primed system, one of said motor speeds being sufficiently high to produce a head that will prime the water circulating system, the other of said motor speeds being lower than said one speed and sufficient to provide a low water circulation rate through said water circulating system but not to prime said system; and switch means for selecting a motor speed to thereby achieve a water circulation rate in accordance with the system head curve so that the most efficient circulation rate required to maintain a desired degree of pool water clarity may be selected thereby providing a more efficient filter system and for selecting said one speed when the water circulating system must be primed.

2. A swimming pool filter system as described in claim 1, additionally comprising a water-heater means disposed in said circulating system.

3. A swimming pool filter system as described in claim 1, wherein said motor includes a dual stator winding which may be selectively energized by said switch means to provide said two motor speeds.

4. A swimming pool filter system as described in claim 1, wherein the switch means includes a timer means for automatically selecting preset motor speeds during selected periods of time.

5. A swimming pool filter system as described in claim 1, wherein one of said two motor speeds is approximately one-half of the other motor speed.

6. A swimming pool filter system as described in claim 5, wherein the motor speeds are nominally 3500 RPM and 1750 RPM.

* * * * *

REEXAMINATION CERTIFICATE (921st)

United States Patent [19]

Frederick

[11] B1 4,421,643

[45] Certificate Issued Sep. 20, 1988

[54] SWIMMING POOL FILTERING SYSTEM

[75] Inventor: Stanley H. Frederick, Ramsey, N.J.

[73] Assignee: International Telephone and Telegraph Corporation, New York, N.Y.

Reexamination Request:
No. 90/001,429, Jan. 29, 1988

Reexamination Certificate for:

| | |
|---|---|
| Patent No.: | **4,421,643** |
| Issued: | **Dec. 20, 1983** |
| Appl. No.: | **946,979** |
| Filed: | **Sep. 29, 1978** |

Related U.S. Application Data

[63] Continuation of Ser. No. 742,387, Nov. 16, 1976, abandoned, which is a continuation of Ser. No. 627,179, Oct. 30, 1975, abandoned.

[51] Int. Cl.[4] ..... E04H 3/20

[52] U.S. Cl. ..... 210/138; 4/507; 210/169; 210/181; 210/416.2; 417/12

[58] Field of Search ..... 210/181, 138, 169, 416.2; 4/507, 509; 417/12

[56] References Cited

FOREIGN PATENT DOCUMENTS

| | | |
|---|---|---|
| 265914 | 5/1963 | Australia . |
| 1613696 | 3/1972 | Fed. Rep. of Germany . |
| 2092285 | 1/1972 | France . |

OTHER PUBLICATIONS

Fachbuch "Elektrische Maschinen," von Rudolf Richter, 4.Bd. Die Induktionsmaschinen, Verlag Birkhauser, Basel/Stuggart Ausg. 1954, pp. 331-332.

*Primary Examiner*—Peter A. Hruskoci

[57] ABSTRACT

A swimming pool filtering system of the closed recirculatory type having a series connected strainer, pump and filter is provided with a close coupled pump drive motor having two sets of stator windings for allowing the selection of one of two water circulation rates to achieve more efficient pool water maintenance. A specific circulation rate may be manually selected or periods of selected circulation rates may be automatically programmed using a motor stator that is energized through a timer. Reduced pump speed during periods of little or no use results in substantial energy savings and a reduction of noise pollution during evening hours.

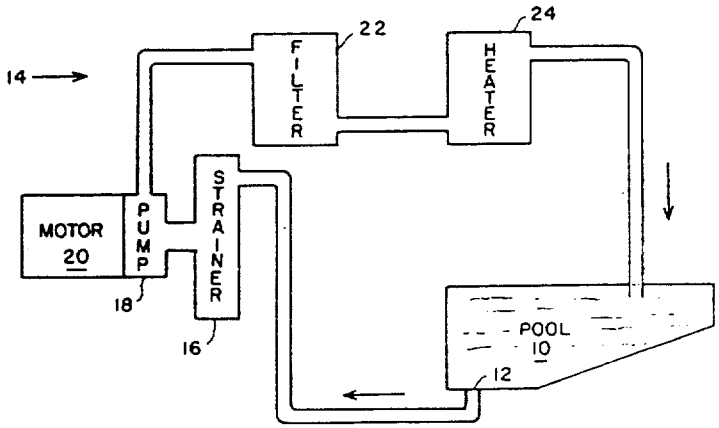

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-6 is confirmed.

* * * * *